United States Patent [19]

Nagasawa

[11] Patent Number: 4,783,021

[45] Date of Patent: Nov. 8, 1988

[54] APPARATUS FOR SUPPLYING PACKAGES TO A CREEL

[75] Inventor: Isao Nagasawa, Kusatsu, Japan

[73] Assignee: Murata Kikai Kabushiki Kaisha, Kyoto, Japan

[21] Appl. No.: 6,705

[22] Filed: Jan. 23, 1987

[30] Foreign Application Priority Data

Jan. 27, 1986 [JP] Japan ..... 61-16451

[51] Int. Cl.[4] ..... B65H 49/02; D02H 1/00

[52] U.S. Cl. ..... 242/131.1; 28/193; 198/487.1; 242/35.5 A; 414/280; 414/331; 414/347; 414/590; 414/621; 414/908

[58] Field of Search ..... 242/131, 131.1, 35.5 A; 28/193; 198/430, 432, 468.6, 486.1, 487.1, 803.12; 414/331, 345, 347, 349, 351, 352, 395, 400, 280, 277, 281, 564, 589, 590, 621, 908

[56] References Cited

U.S. PATENT DOCUMENTS

| | | | |
|---|---|---|---|
| 1,951,400 | 3/1934 | Dvorak | 198/486.1 X |
| 2,013,770 | 9/1935 | Stein et al. | 242/131.1 |
| 2,643,761 | 6/1953 | Wagner et al. | 198/486.1 |
| 3,460,689 | 8/1969 | Furst | 242/131.1 X |
| 3,575,359 | 4/1971 | Furst | 242/131 |
| 3,586,178 | 6/1971 | Zurheide et al. | 242/131.1 X |
| 3,602,456 | 8/1971 | Schmidt | 242/131.1 |
| 3,924,762 | 12/1975 | Igel | 414/331 |
| 4,088,226 | 5/1978 | Vicek et al. | 198/487.1 X |
| 4,498,644 | 2/1985 | Kupper et al. | 242/131.1 |
| 4,669,942 | 6/1987 | Nagasawa | 242/35.5 A |

*Primary Examiner*—Stanley N. Gilreath

*Attorney, Agent, or Firm*—Spensley Horn Jubas & Lubitz

[57] ABSTRACT

An apparatus for supplying packages to a warper creel having a plurality of package supporting pegs comprises a lining station for lining up packages transported on a conveyor in a predetermined order, and a package exchanging apparatus located between the lining station and the positioned creel for transferring a plurality of packages lined up at the lining station collectively to the pegs on the creel.

21 Claims, 13 Drawing Sheets

APPARATUS FOR SUPPLYING PACKAGES TO A CREEL

FIELD OF THE INVENTION AND RELATED ART STATEMENT

This invention relates to an apparatus for supplying packages to a warper creel in a warping machine.

In a warping machine which is used for a warp preparing step for a weaving machine, yarns drawn out from a large number of supply yarn packages fitted on a warper creel (hereinafter referred to only as a creel) are wound on a warper drum. Accordingly, a very large number of packages equal to the number of warps to be used in the weaving machine are supported in a vertical plane of upward and downward and leftward and rightward directions on the creel in such a spaced relationship that yarns released from the packages may not interfere with each other. Thus, for example, one thousand and several hundreds packages may be fitted on and supported by pegs on the creel in good order.

As to supply of packages to such a creel, packages after doffed from a winder of a preceding step are manually supplied one by one by an operator.

Where packages are supplied by an operator in such a manner as described above, the height of the creel may be such as to require use of a bogie truck, and the operability is low because the operator may have to walk between a package store and the creel several times and the weight of the packages is high and may be 3 to 5 kg, which additionally makes the operation dangerous. Further, layers of yarns on packages may be soiled by an operator, resulting in deterioration in quality of the yarns.

OBJECT AND SUMMARY OF THE INVENTION

It is an object of the present invention to provide an apparatus for transferring and fitting a plurality of packages at a time onto pegs of a creel.

According to the present invention, an apparatus for supplying packages to a creel comprises a lining station for lining up packages transported on a conveyor in a predetermined order, and a package exchanging apparatus located between the lining station and the positioned creel for transferring a plurality of packages lined up at the lining station collectively to the pegs on the creel.

Packages transported on a conveyor are lined up in a spaced relationship from each other in a pitch equal to the pitch of the pegs of the creel via transporting media. Thus, after a predetermined number of packages have been lined up, they are carried and transported collectively by an arm of the exchanging apparatus so that a plurality of such packages are fitted at a time on the pegs of the opposed creel.

DETAILED DESCRIPTION OF PREFERRED EMBODIMENTS

Now, an embodiment of the present invention will be described with reference to the drawings.

Figure 2:
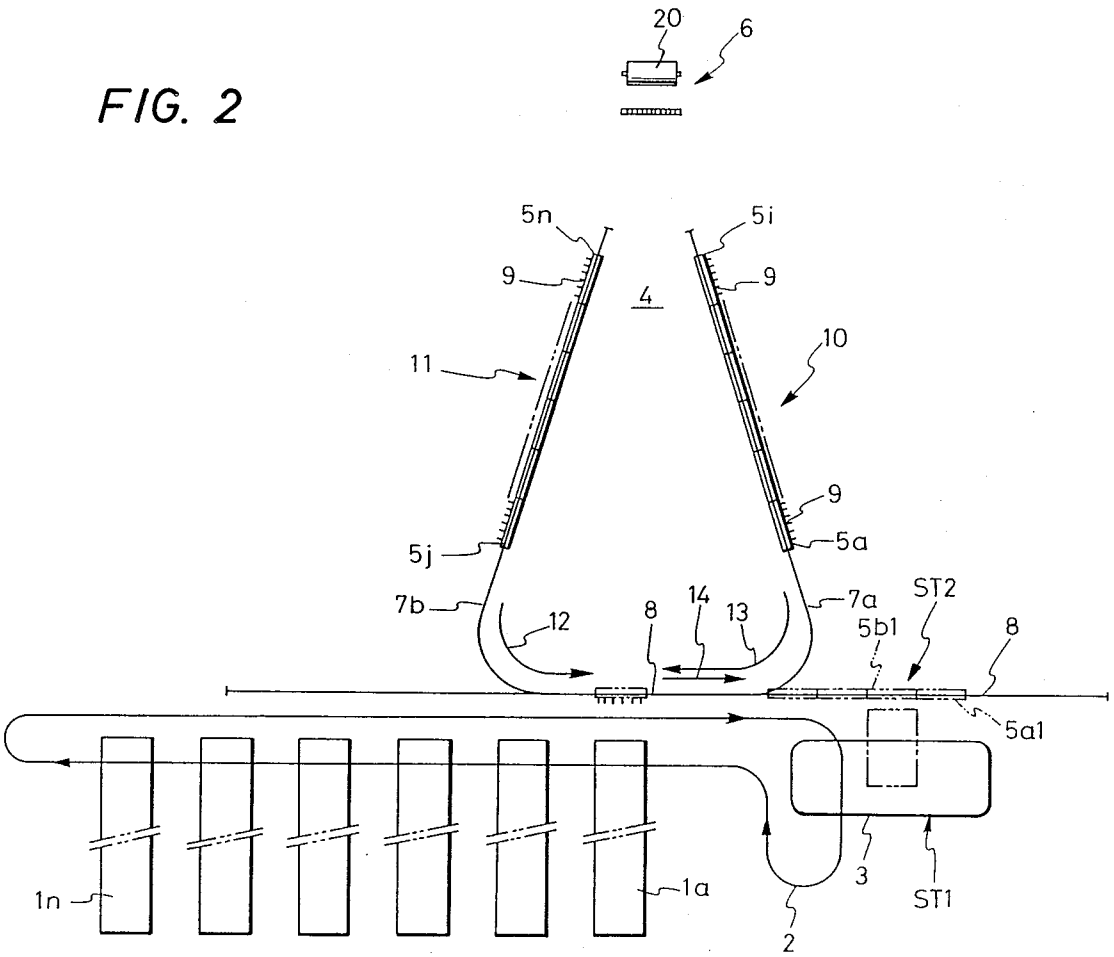
FIG. 2 a plan layout view illustrating an example of a warper creel transporting system.

Referring to FIG. 2, there is shown an example of a package transporting system. Packages produced, for example, on a plurality of automatic winders 1a to 1n are suspended on hangers which travel along a ceiling rail 2 and are transported to a package lining station ST1 at which they are removed from the hangers. After then, they are placed independently one by one on a belt conveyor 3 which will be hereinafter described for transportation thereof by way of transporting media.

Meanwhile, warper creels **5*a* to 5*n* and a warping machine 6 are located in a warp preparing area 4. Each of the creels 5*a* to 5*n* is composed of a frame member on which a large number of package supporting pegs are located in good order in rows and columns. The creels 5*a* to 5*n* are divided into two groups 10 (5*a* to 5*i*) and 11 (5*j* to 5*n*) arranged in an inverted truncated V-shape. The creels 5*a* to 5*n* can move along rails 7*a*, 7*b* which join together with a single rail 8 which extends to the package lining station ST1. In particular, where pegs 9 are located on one face of the frame member of each of the creels 5*a* to 5*n*, the creels 5*j* to 5*n* of one of the creel groups, 11 can be arranged such that the pegs thereof may oppose to the lining station ST1. However, in order that the pegs 9 of the creels 5*a* to 5*i* of the other group 10 can oppose to the lining station ST1, they must once be moved in a direction of an arrow mark 13 until they are transferred to the rail 8 and then they must be moved in the opposite direction 14 on the rail 8** again.

It is to be noted that such movement of the creels **5*a* to 5*n*** may be performed either manually or automatically.

(I) Creel

Figure 3:
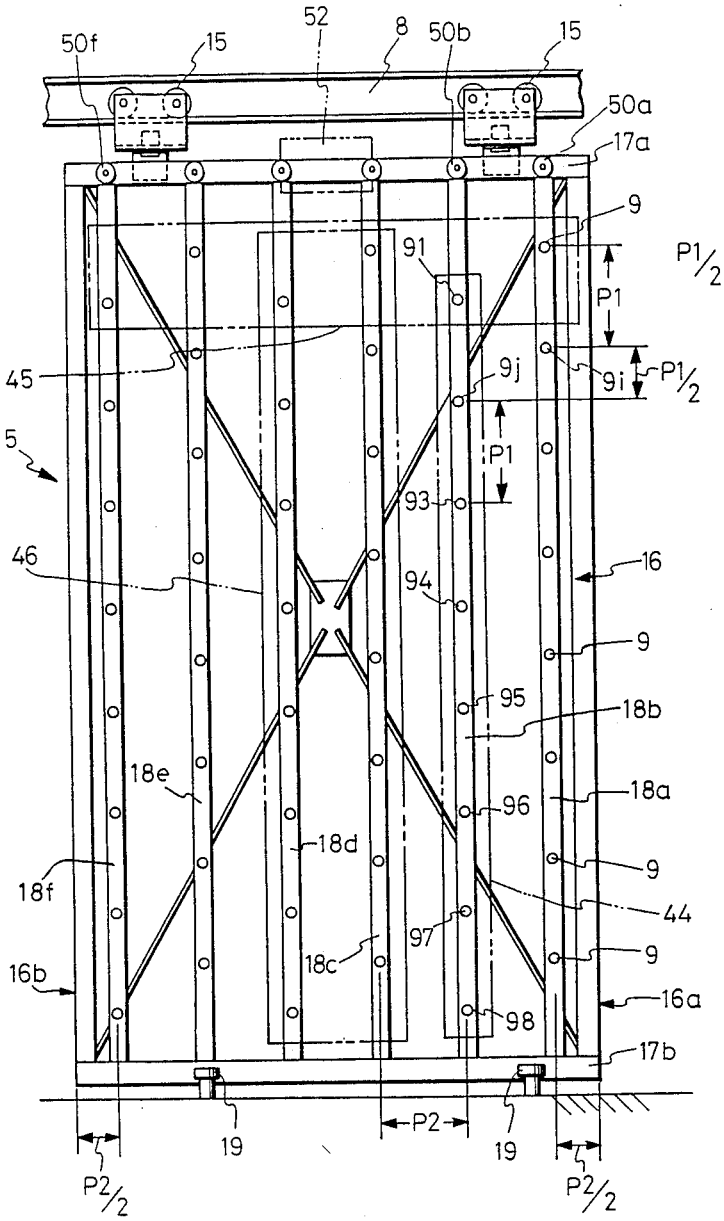
FIG. 3 is a front elevational view illustrating an example of a warper creel.
Figure 4:
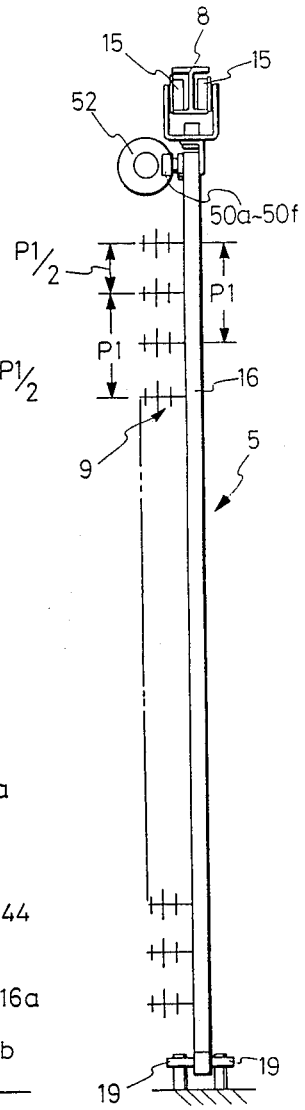
FIG. 4 is a side elevational view of the warper creel of FIG. 3.

Referring now to FIGS. 3 and 4, there is shown an example of such creels 5*a* to 5*n*. In particular, the creels 5*a* to 5*n* have an identical structure, and hence they may each be referred to as a creel 5 herein. A creel 5 includes a frame member 16 suspended on the ceiling rail 8 by way of wheels 15, a plurality of peg frames 18*a* to 18*f* secured to and extending between a pair of upper and lower frames 17*a*, 17*b*, and a plurality of package supporting pegs 9 securely mounted in an equally spaced relationship in a column on each of the peg frames 18*a* to 18*f*. Guide rollers 19 are located on opposite sides of the lower frame 17*b* of the frame member 16 and contribute to stabilization of the creel upon movement of the creel or upon warping operation or else upon loading or unloading of packages.

In the embodiment shown, each creel includes 6 columns of pegs 9 spaced horizontally by an equal pitch P2 from each other and each including 8 pegs 9 securely mounted in a spaced relationship from each other by a pitch P1 such that the pegs 9*i*, 9*j* in each adjacent pair of rows are offset by P1/2 and hence arranged in a zigzag pattern so that layers of yarns of adjacent packages may not interfere with each other, making use of a spacing effectively.

(II) Lining Station (ST1)

Figure 1:
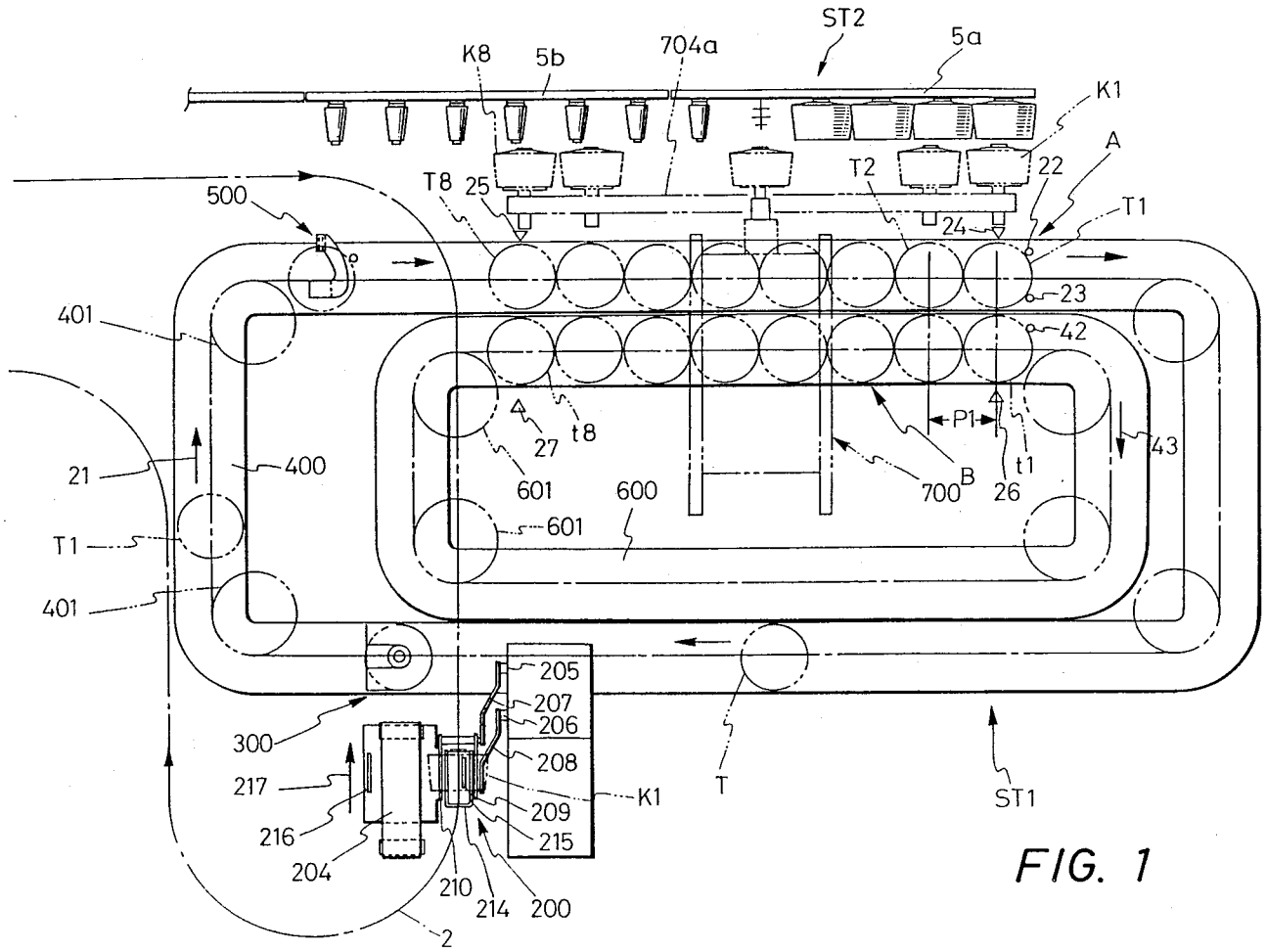
FIG. 1 is a plan view showing a package supply system to which an apparatus of the present invention is applied.

Referring now to FIG. 1, the package lining station ST1 is shown. The package lining station ST1 includes an unloading apparatus 200 which unloads a package transferred along the ceiling rail 2 and places it onto a conveyor, a transfer apparatus 300 which transfers the package thus placed on the conveyor to and fits it onto a transporting medium (hereinafter referred to as a tray T), a conveyor system 400 which transports the package on the tray to the lining station, a yarn end finding apparatus 500 located intermediate the conveyor path between the transfer apparatus 300 and the lining position A for finding an end of a yarn on the package, an empty take-up tube transporting conveyor system 600 which transports a similar tray onto which an empty take-up tube is transferred, a package exchanging apparatus 700 which collectively transfers a plurality of packages at the lining position A to and fits them onto a creel 5 at a stand-by position.

Now, the individual apparatus which are included in the package lining station will be described.

(II-a) Package Exchanging Apparatus 700

Figure 6:
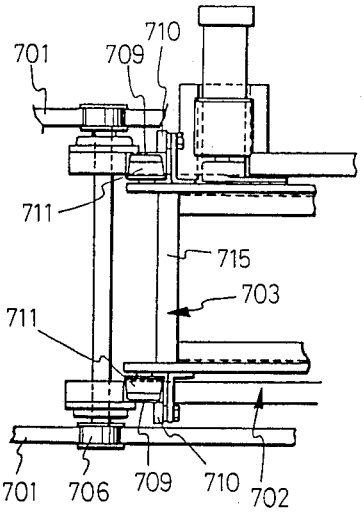
FIG. 6 is a plan view of part of the package exchanging apparatus of FIG. 5.
Figure 5:
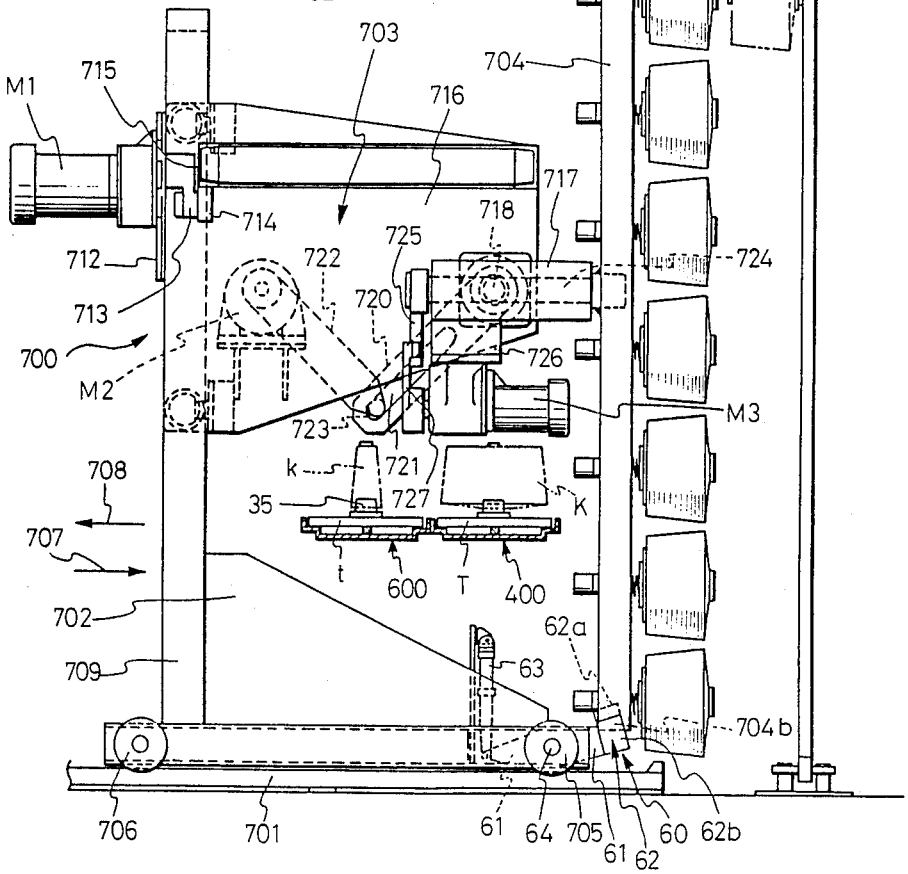
FIG. 5 is a side elevational view showing an embodiment of a package exchanging apparatus.
Figure 7:
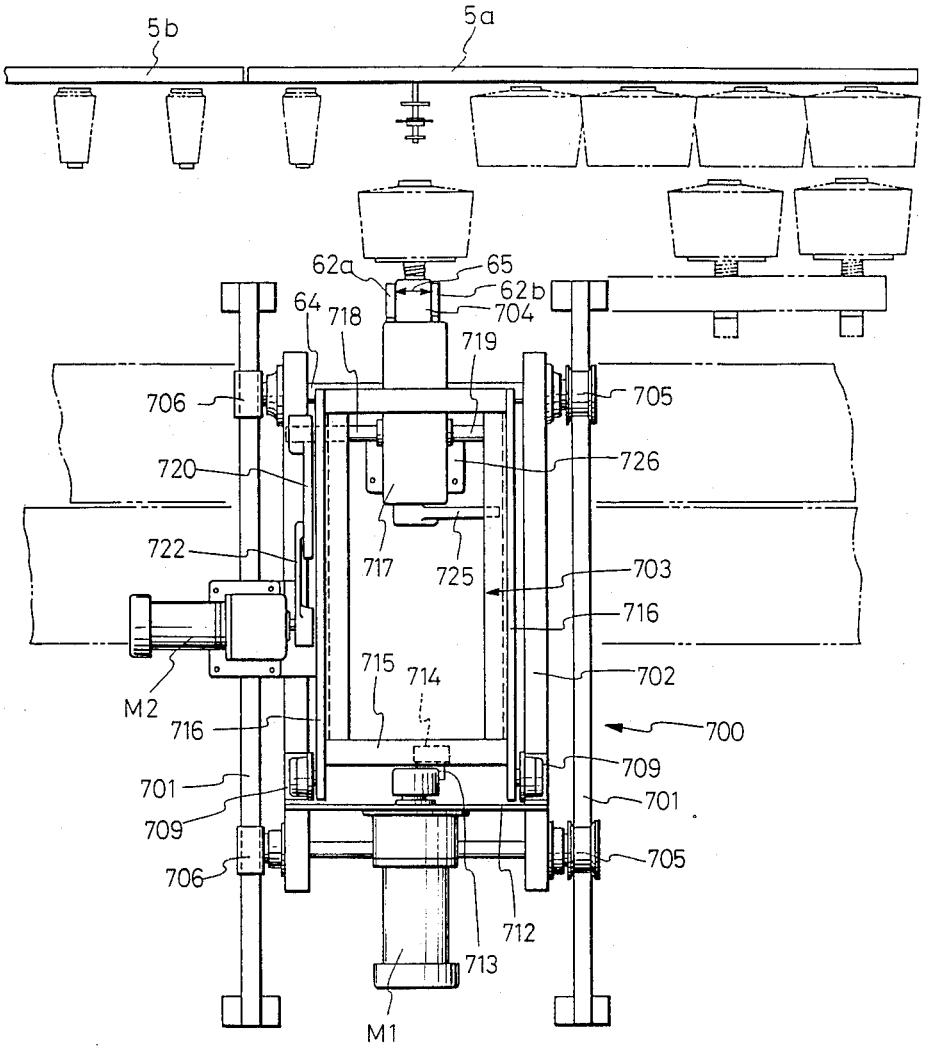
FIG. 7 is a plan view of the package exchanging apparatus of FIG. 5.

Referring to FIGS. 5 to 7, the package exchanging apparatus 700 is shown. In particular, the package exchanging apparatus 700 includes a travelling truck 702 mounted for movement on a pair of rails 701 located below the package transporting conveyor 400, a lifting member 703 located on the truck 702, a package transfer arm 704 located on the lifting member 703.

The guide rails 701 extend in a direction transverse to the rail 8 along which opposing creels 5*a* to 5*n* are moved, and the truck 702 is mounted on the rails 701 via two pairs of wheels 705, 706 so that it may be moved in directions indicated by arrow marks 707, 708 in FIG. 5 by a driving means such as a motor or a cylinder not shown. The truck 702 is controlled to stop at either 3 or 4 positions on the rails 701 by stopping position defining means such as limit switches.

Figure 16A:
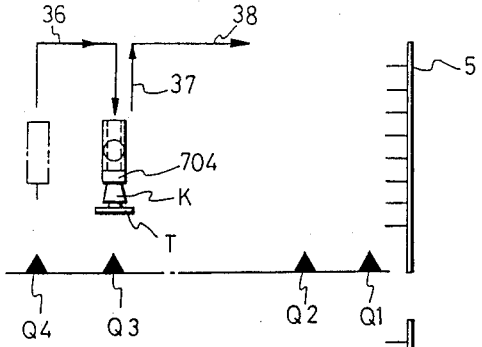
FIGS. 16A to 16D are schematic illustrations showing different stages of a step of supplying packages on trays onto pegs of a creel.
Figure 16B:
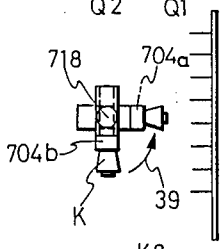

The 3 positions mentioned above include a position Q1 most advanced to a creel 5 of FIG. 16A, that is, a position at which either an empty take-up tube on a peg of a creel is grasped or a yarn supply package is fitted onto a peg on a creel, another position Q4 at which an empty take-up tube k is fitted onto a tray t on the transporting conveyor 600, and a further position Q3 at which a package K at the package lining position is received. It is to be noted that the truck 702 may be stopped at a yet another position Q2 between the positions Q1 and Q3 at which the arm 704 may be turned over.

The lifting member 703 has guide rollers 710, 711 by means of which it can move along rails provided by vertical frames 709 of the truck 702. The lifting member 703 is supported such that a lower face of a cross beam 715 thereof is carried by a roller 714 at an end of a pivotal arm 713 which is secured to an output power shaft of a lifting motor M1 securely mounted on a cross beam 712 extending between the frames 709. Accordingly, as the motor shaft is rotated in a predetermined angle, for example, 180 degrees, in a forward direction and then in the opposite direction, the lifting member 703 on the roller 714 is moved up and down a predetermined distance along the vertical rails 709. It is to be noted the distance of such up and down movement of the lifting member 703 is equal to a half pitch P1/2 between pegs 9 on the creel shown in FIGS. 3 and 4.

A pair of first divided shafts 718, 719 are supported on and extend between frames 716 constituting the lifting member 703 and are securely mounted on opposite side walls of a housing 717. A lever 720 is secured to an end of the first shaft 718 and has an elongated slot 721 formed therein. A pin 723 is located at an end of a lever 722 on a motor M2 integrally supported on the frame 716 of the lifting member 703 and is slidably fitted in the elongated slot 721 of the lever 720 so that the lever 720 may follow pivotal motion of the lever 722 within a predetermined angular range to make a pivotal motion by a predetermined angle around the shaft 718 to pivot the housing 717 secured to the shaft 718 back and forth within a plane of FIG. 5. It is to be noted that the pivoting angle of the housing 717 is 90 degrees and is thus pivoted 90 degrees in a clockwise direction around the shaft 718 from the position shown in FIG. 5. The rotational angle of the housing 717 is determined by the length of the slot 721 of the lever 720 or by the rotational angle of the shaft of the motor M2.

Further, a second shaft 724 extends in a direction perpendicular to the first shaft 718 through the housing 717 and is supported for rotation on the housing 717 by means of a bearing.

The package supporting arm 704 is secured to a forward end of the second shaft 724 adjacent a creel while an elongated slotted lever 725 similar to the lever 720 is securely mounted on the opposite rearward end of the second shaft 724. Meanwhile, a motor M3 for rotating the second shaft 724 is carried on a bracket 726 integral with the housing 717 and has a lever 727 secured to a shaft thereof. The lever 727 is connected to the lever 725 secured to the second shaft 724 by way of a pin in a similar manner as the lever 722.

The range of such pivotal motion of the lever 725 is also set to 90 degrees similarly to the lever 720 on the first shaft. Accordingly, the arm 704 secured to the end of the second shaft 724 is pivoted 90 degrees in a direction perpendicular to the plane of FIG. 5 as the shaft 724 is rotated. Thus, the arm 704 can assume a position 704a parallel to the floor as indicated in phantom in FIG. 1 and another position 704 vertical to the floor as shown in FIG. 5.

Figure 8:
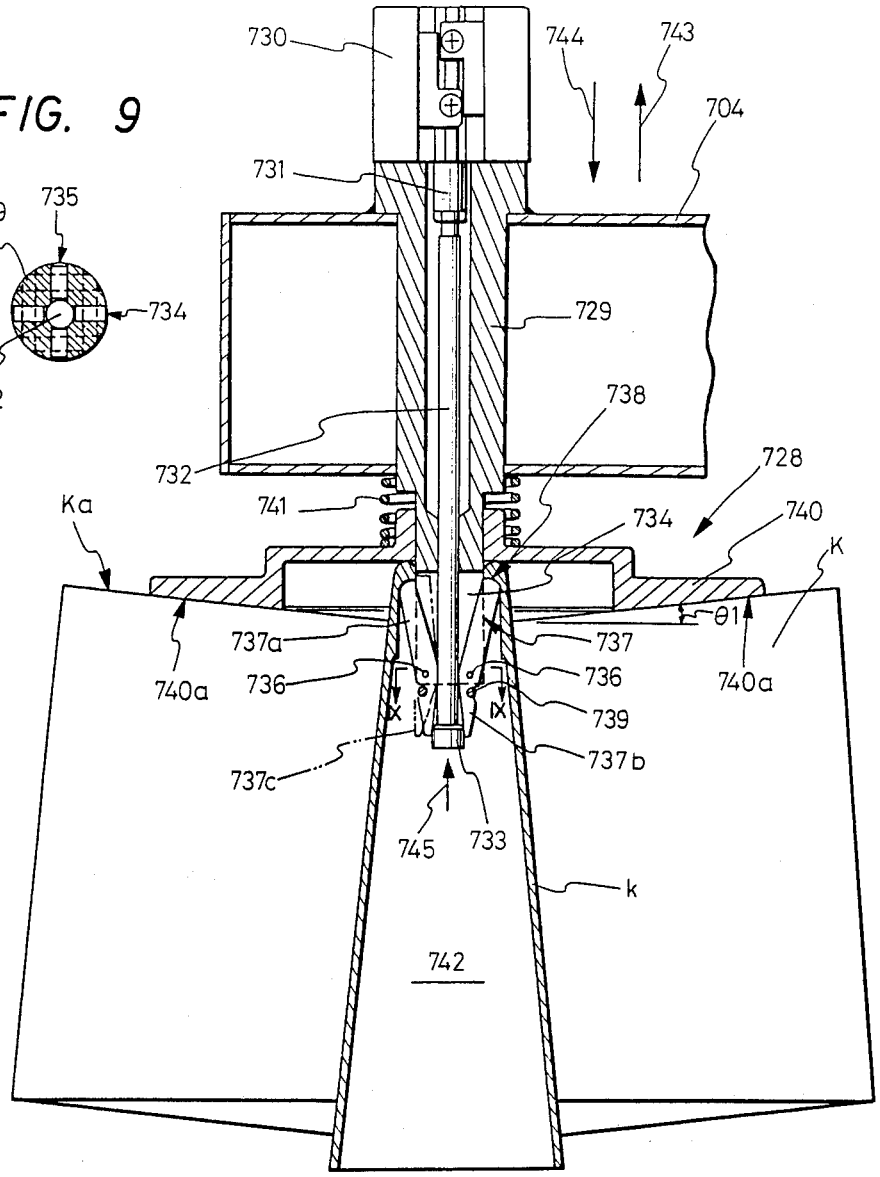
FIG. 8 a front elevational sectional view showing an example of a chucking device provided on a package supporting arm.

Now, an example of a package supporting device 728 located on the arm 704 will be described with reference to FIG. 8. A number of such package supporting devices 728 equal to the number of the pegs in each column on a creel are located on the elongated arm 704 in a same pitch P1 as the pitch P1 between the pegs on a creel. Thus, in the present embodiment, up to 8 packages can be collectively supplied to and fitted onto a creel. Referring to FIG. 8, a supporting cylindrical member 729 extends through and is securely mounted on the arm 704 and has a hydraulic cylinder 730 secured to an end thereof. A package supporting rod 732 is secured to a piston rod 731 of the cylinder 730 and extends through the cylindrical member 729. A cylindrical cam 733 is formed at an end portion of the rod 732.

Figure 9:
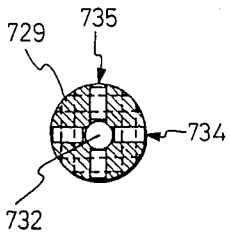
FIG. 9 a sectional view taken along line IX—IX of FIG. 8.

Cross slits 734, 735 are formed at an end portion of the supporting cylindrical member 729 as shown in FIG. 9, and a chucking member 737 is accommodated in each of the slits 734, 735 and is supported for rocking motion around a pin 736.

In the present embodiment, up to 4 such chucking members 737 are provided. Each of the chucking members 737 has an engaging portion 737*a* for engaging with an inner end portion 738 of a take-up tube k of a package K to grasp and suspend the package K thereon, and a cam face 737*b* for engaging with the cam 733 at the end of the rod 732 to release the grasp of the package. A spring 739 in the form of a ring is received in recesses of the four chucking members 737 between the support shafts 736 and ends of the cam faces 737*b* of the chucking members 737 to urge the chucking members 737 in a direction to engage the engaging portions 737*a* thereof with the take-up tube.

A pressing disk 740 for pressing an end of a yarn found by a yarn finding apparatus which will be hereinafter described and located on an end face Ka of a layer of the yarn of a package K against the yarn layer end face Ka of the package K to prevent the yarn end from dropping therefrom during transportation of the package K is slidably mounted on an outer periphery of the supporting cylindrical member 729. A compression spring 741 is located between the pressing plate 740 and the arm 704 to urge the pressing plate 740 to press against the end face of the package. A yarn contacting face 740*a* of the pressing plate 740 is a disk-shaped tapered face which is tapered at an angle equal to the angle of a taper of the package end face Ka so as to assure effective grasping of an end of a yarn.

Accordingly, when the chucking members are to grasp thereon a package on a tray or an empty take-up tube on a peg of a creel, the chucking members 737 are brought to respective positions shown in solid lines and then the arm 704 itself is moved in a direction of an arrow mark 744 toward the inside of a center hole 742 of a take-up tube k from outside whereupon the engaging portions 737*a* of the chucking members 737 are forcibly pressed by an end entrance of the take-up tube so that all the chucking members 737 are displaced to respective phantom positions 737*c* against a force of the spring 739 and thus allowed to advance into the take-up tube k. After the chucking members 737 have entered entirely, they are pivoted open to the respective full line positions 737 by the force of the spring 739. Accordingly, as the arm 704 is then moved in a direction of an arrow mark 743, the package K is grasped by the chucking members 737. On the contrary, when the package is to be released from the chucking members 737, the cylinder 730 is operated from a condition shown in FIG. 8 to move only the rod 732 in a direction of an arrow mark 745. Consequently, the cam 733 is engaged with the tapered cam faces 737*b* to forcibly pivot the chucking members 737 to their respective phantom positions 737*c*. Then, as, in this condition, the entire arm 704 is moved in the direction of the arrow mark 743, the chucking members 737 are removed from the take-up tube k.

It is to be added that a positioning apparatus 60 for positioning the vertical position of the arm 704 is located at a lower part of the truck 702 as shown in FIG. 5. In particular, the positioning apparatus 60 includes a rockable lever 60 located in a same vertical plane below the second shaft 724, an offset recess 62 located at an end portion of the lever 61 for receiving a lower end portion of the arm 704, and a cylinder 63 for operating the lever 61. The lever 61 is loosely fitted on a shaft 64 of the wheel 705 and is rocked, as the cylinder 63 operates, between a position in which it is engaged with the arm 704 (position shown in FIG. 5) and another position in which it is spaced away from the arm 704.

The recess 62 is defined by vertical walls 62*a*, 62*b* which are spaced apart from each other by a distance substantially equal to the thickness (65 in FIG. 7) of the arm 704. The wall 62*a* has an upper edge higher than that of the other wall 62*b*. Accordingly, if the arm 704 is pivoted in a direction from front to rear of the plane of FIG. 5 to its vertical position while the lever 61 is at its stand-by position, a lower end portion 704*b* of the arm 704 is engaged with only part of the wall 62*a*, and then if the lever 61 is moved to the full line position of FIG. 5, the arm 704 is positioned with the lower end portion 704*b* thereof held between and by the vertical walls 62*a*, 62*b* adjacent opposite sides of the lower end portion 704*b*. Consequently, the arm 704 is prevented from playing around the shaft 724 by the shaft 724 and the recess 62.

(II-b) Yarn End Finding Apparatus 500

Now, description will be given of a transporting path for trays T shown in the layout of FIG. 1 and an example of the finding apparatus 500 for finding an end of a yarn of a package K transported in an integral relationship with a tray T with reference to FIGS. 10 and 11.

A tray T is a transporting medium for transporting a package K independently of any other package K and includes a base plate 501 in the form of a disk and a projection 502 located at the center of the base plate 501 for supporting a package thereon. The base plate 501 has a diameter D equal to the pitch P1 between vertically adjacent pegs on a creel. Accordingly, if such trays T are lined up i a close contacting relationship along a straight line, packages on the trays will be lined up just by a pitch equal to the pitch P1 between adjacent pegs on a creel.

Figure 11:
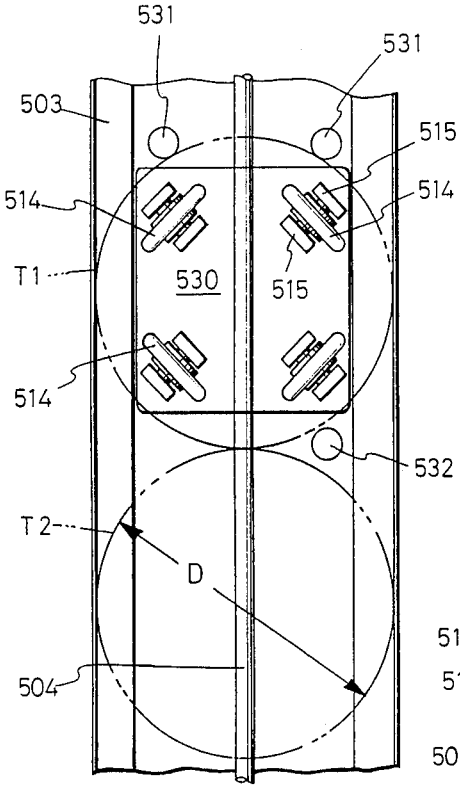
FIG. 11 a partial plan view of the apparatus of FIG. 10.
Figure 10:
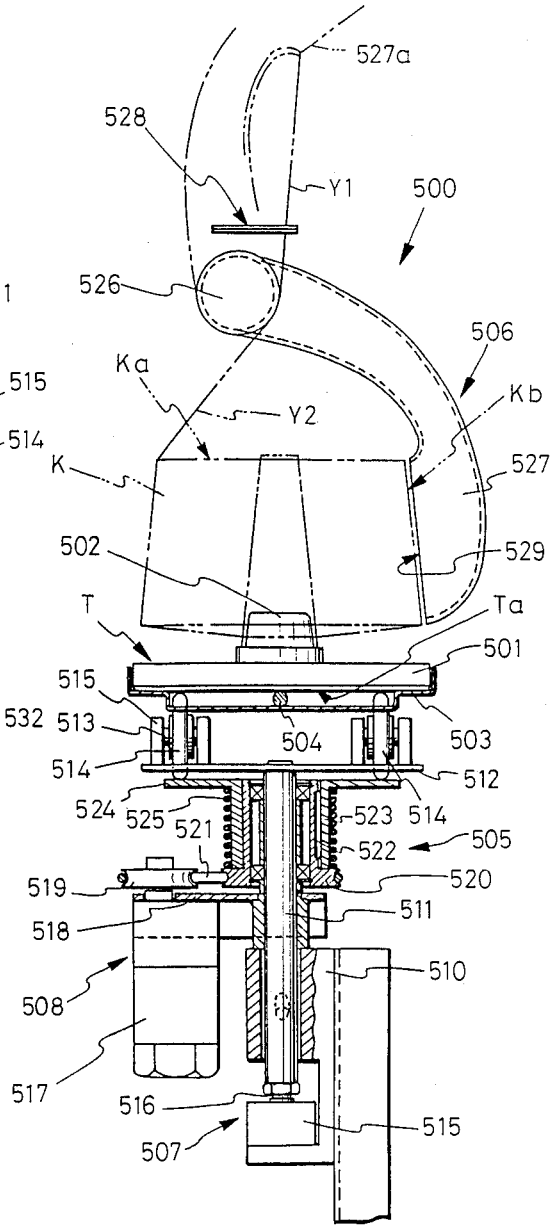
FIG. 10 a side elevational view, partially in section, showing an example of an apparatus for finding an end of a yarn on a package.

It is to be noted that the conveyors 400, 600 of FIG. 1 for transporting trays T each include a guide plate 503 forming a tray transporting path, and a rounded belt 504 for applying a transporting power to the trays as shown in FIGS. 10 and 11. The rounded belt 504 runs under the trays T so that the trays T are transported in a running direction of the rounded belt due to a frictional force between the rounded belt and bottom faces of the trays T caused by the weight of the trays and packages. It is to be noted that the package transporting path 400 and the empty take-up tube transporting path 600 of FIG. 1 have a similar construction and each extend, in the present embodiment, in the form of a closed loop while one of rotatably supported guide pulleys located at corner portions of each of the transporting paths 400, 600 serves as a driving pulley.

The yarn end finding apparatus 500 is located forwardly of the package lining position A of the transporting path 400 and includes, as shown in FIGS. 10 and 11, a rotating means 505 for rotating a package K at a yarn end finding up position in a direction to release a yarn from the package K, a drawing out means 506 for attracting an end of a yarn present on an outer surface of a yarn layer on the package.

The package rotating means 505 includes a tray lifting mechanism 507 for lifting a tray T from the conveyor 504, and a rotationally driving mechanism 508 for rotating the tray T. In particular, a roller supporting plate 512 is secured to an upper end of a lifting shaft 511 which extends vertically through a securing bracket 510. A plurality of rollers 514 are supported for rotation around horizontal shafts 513 on bearings 515 secured to the roller supporting plate 512 and are arranged in a manner as shown in FIG. 11. Part of an outer periphery of each of the rollers 514 extends downwardly through and below an opening formed in the plate 512. A lower end of the shaft 511 is connected to a piston rod 516 of a hydraulic cylinder 515. It is to be noted that the lifting amount of the shaft 511 must be sufficient to lift a tray T to a position in which a lower face Ta thereof is not in contact with the rounded belt 504.

Further, a bracket 518 is securely mounted on the shaft 511, and a motor 517 is mounted on the bracket 518. A belt 521 extends between and around a pulley 519 mounted on a shaft of the motor 517 and another pulley 520 supported for rotation on the shaft 511. A rotary member 523 is supported for integral rotation with the pulley 520 and also for sliding movement by a little distance in a direction of an axis of the shaft 511 on an outer periphery of a cylindrical portion 522 integral with the pulley 520. A spring 525 is interposed to urge the rotary member 523 to press an upper face of a disk 524 integral with the rotary member 523 against the rollers 514.

Accordingly, as the shaft 511 is lifted, a tray T is released from the belt 504, and at this position, the motor 517 is driven to rotate the rollers 514 via the disk 524 thereby to rotate the tray T and hence a package K thereon in the yarn releasing direction.

The yarn end drawing out means 506 includes a suction mouth 527 mounted for pivotal motion around a hollow shaft 526 at a fixed position, and a cutter device 528 located midway of a yarn path Y1 provided by pivotal motion of the suction mouth 527. In particular, the suction mouth 527 is pivoted between a full line position 527 and a phantom position 527*a* around the shaft 526 by a driving mechanism not shown, and at the full line position 527, a suction opening 529 thereof approaches an outer surface Kb of a yarn layer on a package so that it may suck and release a yarn end as the package is rotated. In this condition, if the suction mouth 527 is pivoted in a counterclockwise direction to the phantom position 527*a*, a yarn Y1 extending between the package K and the suction mouth 527*a* is introduced into and thus cut by the cutter device 528. Accordingly, a yarn end Y2 connecting to the package K drops onto a top end face Ka of the package K and thus assumes a condition placed on the end face Ka, thereby completing the yarn end finding operation.

It is to be noted that in FIG. 11, reference numeral 530 denotes an opening perforated in each tray and the guide plate 503 for the rounded belt for passing the rollers 514 therethrough, and 531 a stopper for stopping a tray T1 at the yarn end finding position. The stopper 531 is formed from a piston rod, for example, of a hydraulic cylinder. Reference numeral 532 denotes another stopper for temporarily stopping a following tray T2 when the tray T1 after completion of the finding up of a yarn end thereof is to be delivered.

(II-c) Package Unloading Apparatus 200

Now, the apparatus (200 in FIG. 1) for unloading a package suspended on and transported thereto by a ceiling travelling hanger will be described with reference to FIGS. 1 and 12.

A chain runs within the guide rail 2 which constitutes a package transporting path, and an L-shaped package supporting hook 202 is connected to the chain 201 so that a package K may be transported in a direction of an arrow mark 203 as the chain runs.

The apparatus 200 for unloading a package K on a hook 202 onto the conveyor 204 below includes a pair of levers 207, 208 mounted for turning motion around shafts 205, 206, and a pair of package transferring members 209, 210 connected between the levers 207, 208. In particular, the distance between the shaft 205 and another shaft 211 is equal to the distance between the shaft 206 and a further shaft 212 so that as the levers 207, 208 are pivoted in a synchronized relationship, the transferring members 209, 210 move around the shafts 205, 206 while making a parallel motion. While the levers 207, 208 are turned in one complete rotation in a direction of an arrow mark 213, the apparatus 200 unloads a package K from a hook 202 and places it onto the transferring members 209, 210, and then transfers the package K1 on the transferring members 209, 210 onto a package receiving table 214 secured to a location sidewardly of the conveyor as the transferring members 209, 210 pass the package receiving table 214. Further, a projecting plate 215 projects above the receiving table 214 and is displaced a little from an axis of the package so that a package K1 placed on the receiving table 214 in a condition as shown in FIG. 1 is rolled to and thus received on the conveyor 204. Reference numeral 216 denotes a stopper for stopping a package thus being rolled. The package K1 received on the conveyor 204 in this manner is then transported on the conveyor in a direction of an arrow mark 217 of FIGS. 1, 12.

(II-d) Apparatus 300 for Transferring a Package onto a Tray

Figure 13:
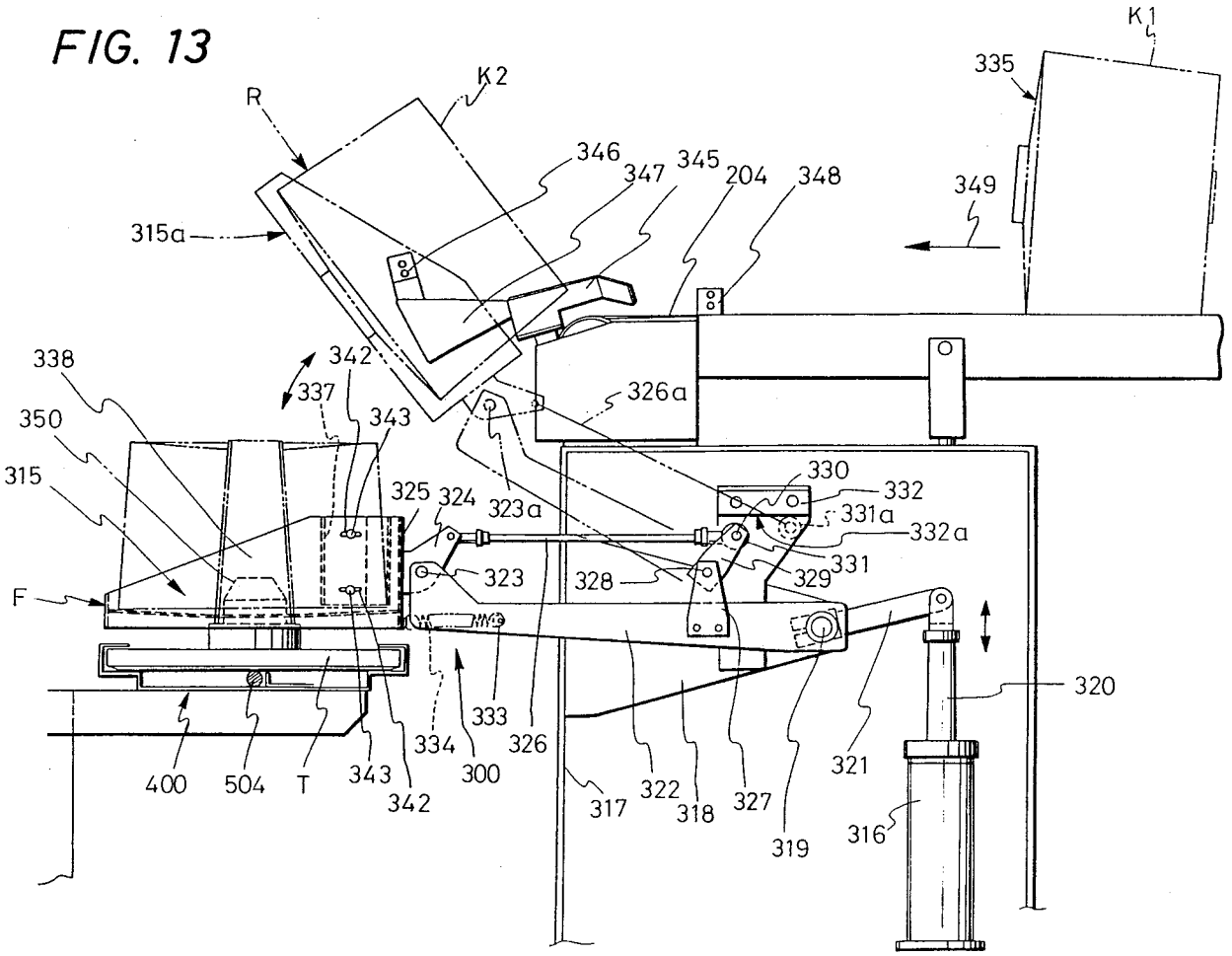
FIG. 13 a side elevational view showing an example of an apparatus for transferring a package to a tray.

The transfer apparatus 300 of FIG. 13 includes a package receiving dish 315 which moves between a package receiving position R adjacent an end of the transporting conveyor 204 and a delivering position F at which a package is delivered onto a tray T on the conveyor 400, a hydraulic cylinder 316 for driving the receiving dish 315, a motion transmitting lever and other components. In particular, a shaft 319 is supported for rotation on and extends between a pair of brackets 318 secured to a frame 317, and a lever 321 is secured at an end thereof to an intermediate portion of the shaft 319 and is connected to a piston rod 320 of the hydraulic cylinder 316 so that the shaft 319 may be rotated in a forward direction and in the opposite direction as the piston rod 320 is moved up and down. One ends of a pair of receiving dish supporting arms 322 are secured to opposite end portions of the shaft 319, and a shaft 323 extends between and supported by the opposite ends of the arms 322. A pair of brackets 324 are supported for pivotal motion on the shaft 323, and a back face 325 of the receiving dish 315 is secured to and supported by the barckets 324.

Further, one ends of a pair of rods 326 are supported for pivotal motion on the brackets 324, and the other end of each of the rods 326 is connected to a lever 329 supported for pivotal motion as at 328 on a plate 327 secured to an intermediate portion of a corresponding one of the arms 322. Further, a pair of rollers 331 are supported on pins 330 and are moved into and out of contact with cam plates 332 securely mounted on a pair of securing brackets 318.

Further, a spring 334 is interposed between the shaft 333 extending between the arms 322 and the back face 325 of the receiving dish 315 to urge the receiving dish 315 in a counterclockwise direction around the shaft 323.

The receiving dish 315 includes a bottom plate 336 for supporting a bottom face 335 of a package K, a reference side plate 337 for supporting an outer periphery of a yarn layer of the package, a frame member 338 for supporting the bottom plate 336 and the reference side plate 337 thereon. The bottom plate 336 has a recess 339 formed therein. The recess 339 is opened in a package delivering direction and is cut deeply further than the position of the center of a package. Thus, the bottom plate 336 effects a delivering operation with a take-up tube k of a package extended downwardly through and below the recess 339.

Meanwhile, the reference side plate 337 has an arcuate portion having a shape partially coincident to that of a package, and a bent portion 341 at which the reference side plate 337 is adjustably positioned on the frame member 338 by means of a pair of bolts 343 which extend through elongated holes 342 formed in the frame member 338. It is to be noted that the other end portion of the side plate 337 is abutted against and positioned by the bolts 344 projected from the frame member rear face 325. Accordingly, if the side plate 337 is adjusted in position depending upon the diameter of a package K2, the center of a package will always assume a same position, and hence a possible error when a package is to be fitted on a tray can be prevented.

Further, on the conveyor 204 side, a pair of guide plates 345 are secured on opposite sides of the package delivering position, and a sensor 346 for detecting a package received on the receiving dish 315 is located on a fixed bracket 347 so that the hydraulic cylinder 316 described above may be rendered operative in response to a package present signal from the sensor 346. Another sensor 348 on the conveyor side is provided to detect arrival of a following package during operation of the receiving dish 315 to stop operation of the conveyor 204.

Accordingly, if the receiving dish 315*a* stands by at a phantom position R in FIG. 13 and a package K1 is fed in a direction of an arrow mark 349 and is dropped from an end of the conveyor 240 into the receiving dish 315*a*, the hydraulic cylinder 316 is rendered operative in response to the sensor 346 to advance the piston rod 320. Consequently, the shaft 319 is rotated in the counterclockwise direction via the lever 321 to turn the arms 322 secured to the shaft 319 so that the receiving dish 315*a* is moved from the phantom position to the full line position 315 to fit the package K2 onto the peg 350 of the tray T.

It is to be noted that at the stand-by position R, the roller 331*a* at the end portion of the rod 326*a* of the receiving dish 315 is controlled by a cam face 332*a* of the cam plate 332 so that the bottom plate 336 of the receiving dish 315*a* is displaced in a direction away from the arms 322 around the shaft 323*a* of the arms 322. Upon pivotal motion of the arms 322 in the counterclockwise direction around the shaft 319, when the roller 331 comes to a position at which it is disengaged from the cam plate 332, the receiving dish 315 is brought to a full line position, that is, a position in which the rear face 325 thereof is engaged with the arms 322, due to the presence of the spring 334 and the weight of the package. Accordingly, a change in posture of a package by 90 degrees can be attained by a pivotal motion of the arms 322 by a smaller angle. For example, if it is assumed that an angle at which a package K1 is dropped into the receiving dish 315 due to its own weight, that is, an angle between packages K1 and K2, is 30 degrees and the pivotal angle of the arms 322 is 30 degrees, a change in angle of the remaining 30 degrees is obtained by the angle of pivotal motion of the receiving dish 315 itself relative to the arms 322. Accordingly, the overall size of the transfer apparatus can be made compact comparing with an arrangement wherein pivotal motion of 60 degrees is obtained only by the arms 322.

Now, an operation to supply a package to a creel will be described.

Referring to FIG. 2, the creels 5*a* to 5*n* on which empty take-up tube after completion of supplying of yarns therefrom to the warper drum 20 are moved manually or automatically on the rails 7*a*, 7*b* until they are positioned in a row along the rail 8 in a package supplying station ST2.

Figure 12:
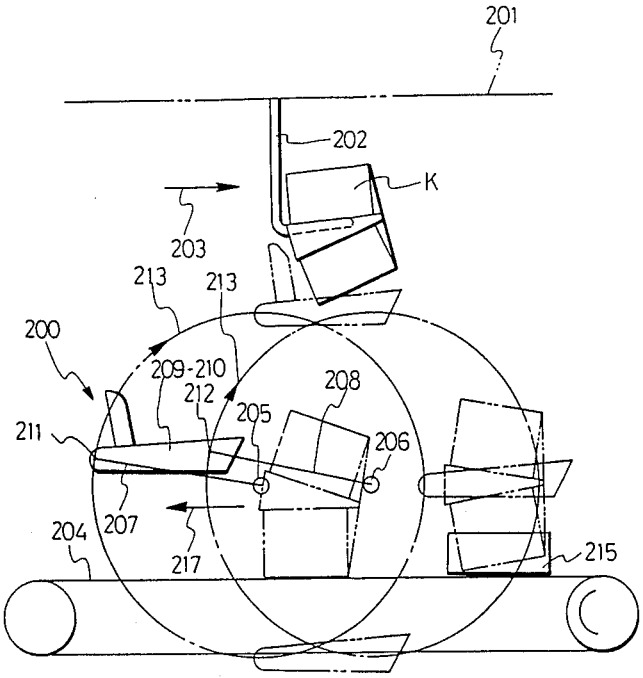
FIG. 12 a schematic illustration showing general construction of an example of an apparatus for unloading a package from a ceiling travelling hanger.
Figure 14:
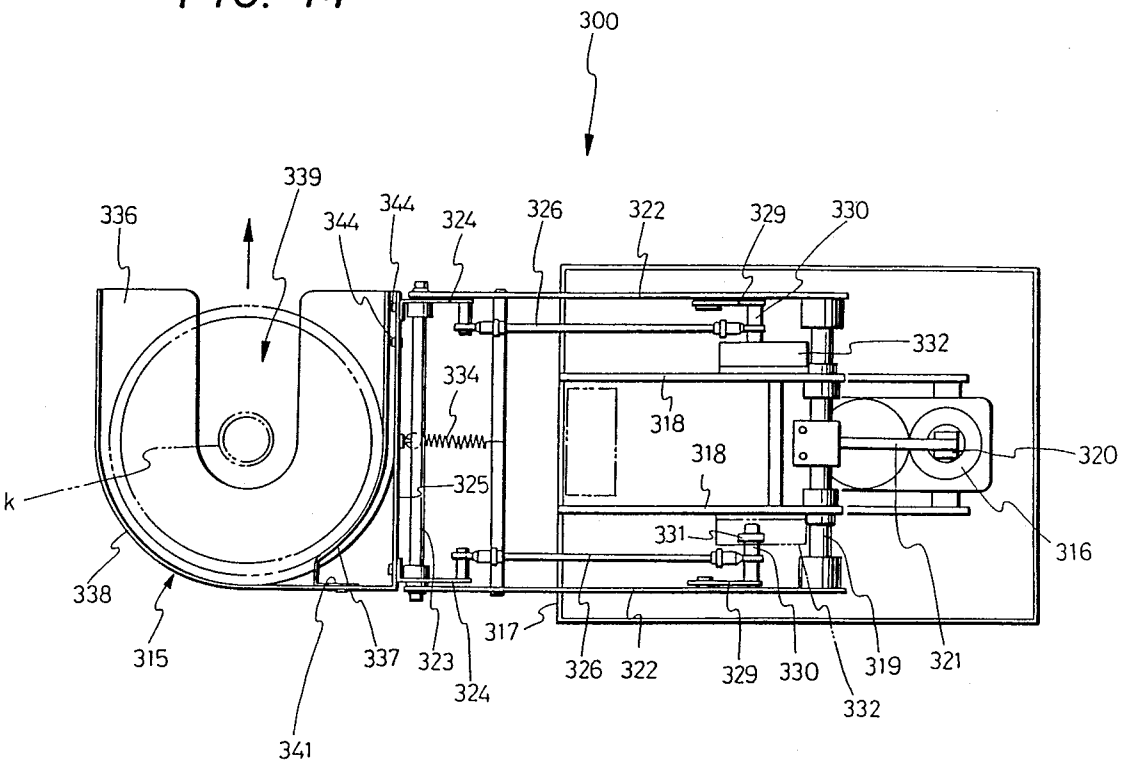
FIG. 14 a plan view of the apparatus of FIG. 13.

Meanwhile, referring to FIG. 1, packages transported from the winder side are fitted one after another onto empty trays T fed on the transporting path 400 by the unloading apparatus 200 shown in FIG. 12 and the package transfer apparatus 300 shown in FIGS. 13, 14. Each tray T1 on which a package is fitted is then fed in the direction of the arrow mark 21 and is stopped once at a position adjacent the finding apparatus 500 so that an end of a yarn present on a surface of a yarn layer on the package may be drawn out by the yarn end finding apparatus 500 shown in FIG. 10. After then, the package on the tray is fed to the lining position A with the yarn end held placed on an upper end face of the package.

At the lining position A, a first one of the trays T1 is stopped and positioned by a pair of stoppers 22, 23 mounted for retreating movement at predetermined locations, and then following trays T2 to T8 on which packages are fitted arrive one after another and are lined up in good order on the transporting path as shown in FIG. 1 with adjacent trays contacted with each other. Upon arrival of a predetermined number of trays T1 to T8 at the lining position A, a pair of photoelectric tube sensors 24, 25 located, for example, adjacent the positions of the trays T1 and T8, are both turned on thereby to detect completion of lining up of the trays T1 to T8.

Meanwhile, empty trays t1 to t8 lined up at a lining position B of the different transporting path 600 are detected by another pair of sensors 26, 27. Thus, after confirmation that the creel 5*a* is positioned at the predetermined position, the package exchanging apparatus 700 is rendered operative.

Now, operation of supplying packages, for example, to pegs 9 of a column 18*b* in which the pegs 9 are displaced downwardly by a half pitch in the creel 5 shown in FIG. 3, will be described.

(a) Step of Drawing Out an Empty Take-Up Tube

Creels after warping operation are positioned in the lining station ST2 in such a condition that completely empty take-up tubes or empty take-up tubes on which yarns remain a little amount are held fitted on pegs thereof. Thus, at first an operation to draw out such empty take-up tubes from pegs 91 to 98 shown in FIG. 3 is performed in an order of FIGS. 15A to 15D.

Figure 15A:
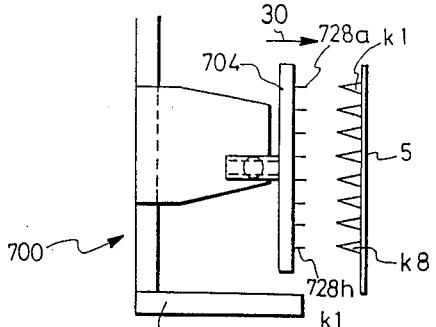
FIGS. 15A to 15D are schematic illustrations showing different stages of a step of drawing out empty take-up tubes from a creel.

In particular, the arm 704 of the exchanging apparatus 700 is positioned to a vertical position as shown in FIG. 15A. In this position, the individual chucking devices 728*a* to 728*h* on the arm 704 are positioned in an opposing relationship to corresponding pegs 91 to 98 on an opposing creel 5, and the truck 702 is moved in a direction indicated by an arrow mark 30 toward the creel 5. Then, empty take-up tubes k1 to k8 on the creel 5 are grasped collectively by the chucking devices 728*a* to 728*h* by a similar operation to that described hereinabove with reference to FIG. 8, and then drawn out from the creel 5 as the truck 702 is retracted.

Figure 15B:
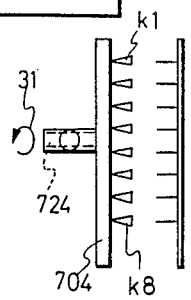
Figure 15C:
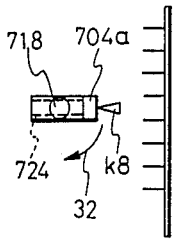
Figure 15D:
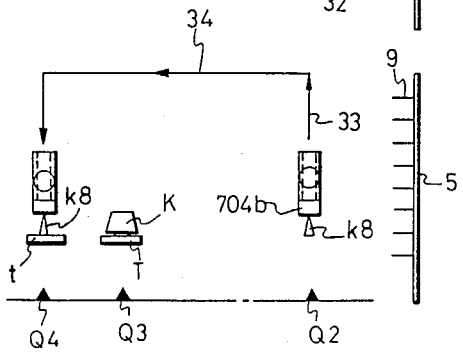

Subsequently, when the arm 704 on which the empty take-up tubes are carried is at a position as shown in FIG. 15B, that is, when the arm 704 in a vertically directed condition is positioned between the package transporting conveyor 400 and the creel 5 as shown in FIG. 5, the motor M3 shown in FIG. 5 is activated to turn the arm 704 ninety degrees in a direction indicated by an arrow mark 31 in FIG. 15B together with the second shaft 724 to a position as shown in FIG. 15C. Then, after the arm 704 has been stopped to a horizontal position 704*a*, the motor M2 of FIG. 5 is activated to turn the first shaft 718 an angle of ninety degrees in a direction indicated by an arrow mark 32 in FIG. 15C to turn the arm 704*a* until the empty take-up tubes k1 to k8 on the arm 704 are directed downwardly, that is, until the arm 704 is positioned to a position 704*b* as shown in FIG. 15D. After then, the motor M1 for the lifting member 703 shown in FIG. 5 is activated to lift 33 the lifting member 703 a predetermined fixed stroke as seen in FIG. 15D. In other words, the lifting member 703 is lifted to such a vertical position at which the empty take-up tubes suspended on the arm 704 may not interfere with packages K on trays T when they are fed in a direction indicated by an arrow mark 34 in FIG. 15D. Subsequently, the entire truck 702 is moved a predetermined fixed distance in the direction of the arrow mark 34 in FIG. 15D to position the empty take-up tubes k1 to k8 to the centers of empty trays t1 to t8, respectively, at stand-by positions on the conveyor 600 of FIG. 1. Then, the motor M1 on the truck 702 is activated to lower the lifting member 703 and hence the arm 704 until the empty take-up tubes k8 to k1 are fitted collectively onto the package supporting projections (35 in FIG. 5) of the empty trays t1 to t8, respectively. After then, the chucking members 737 of FIG. 8 are positioned to the respective phantom positions 737*c* and then the arm 704 is lifted again whereupon the empty take-up tubes k8 to k1 are left fitted on the empty trays t1 to t8, respectively, as shown in FIG. 5.

(b) Package Fitting Step

A package fitting step is performed in an order of FIGS. 16A to 16D. In particular, the empty arm 704 after empty take-up tubes have been transferred therefrom to empty trays is moved as the truck is moved in a direction indicated by an arrow mark 36 in FIG. 16A, to a position above trays T on which packages K are fitted as shown in FIG. 16A. Then, as the lifting member 703 on the truck is moved downwardly, that is, as the arm 704 is moved in the arrow mark 744 in FIG. 8, the chucking members 737 are inserted into the center holes 742 of the packages K and are engaged with inner upper ends of the take-up tubes while yarn ends placed freely on upper end faces of the packages are clamped between the pressing plates 740 and the end faces Ka. Thus, the packages K1 to K8 on the trays T1 to T8 lined up at the package lining position A of FIG. 1 are collectively held by and suspended on the arm 704. Then, the arm is once lifted in a direction indicated by an arrow mark 37 in FIG. 16A to draw out the packages from the trays T1 to T8. In this condition, the truck is moved in a direction indicated by an arrow mark 38 until the arm 704 arrives at the rotating position Q2 thereof. In this position Q2, at first the horizontal arm 704*b* is rotated 90 degrees in a direction indicated by an arrow mark 39 in FIG. 16B around the first shaft 718 to change the orientation of the packages K, and then the arm 704*a* is rotated 90 degrees in a direction indicated by an arrow mark 40 in FIG. 16C around the second shaft 724. Consequently, the arm 704a in the horizontal position is turned to a horizontal position 704 in which the packages K1 to K8 suspended on the arm 704 now oppose to the empty pegs 98 to 91 in the column 18*b* on the creel 5.

After then, the truck is moved in a predetermined fixed distance in a direction indicated by an arrow mark 41 toward the creel 5 thereby to fit all the packages K1 to K8 on the arm 704 onto the pegs on the creel 5. Then, as the truck is returned to the position shown in FIG. 16D, the yarn ends which have been clamped by the pressing plates 740 of FIG. 8 are brought into a free condition in which they remain sticking to the end faces of the packages or either are suspended from surfaces of the packages due to the gravity. This assures facilitation in operation to draw out the yarn ends or in yarn splicing operation when the creel to which the packages have been supplied is positioned at the initial warping station. In other words, the yarn ends can be found easily.

Figure 16C:
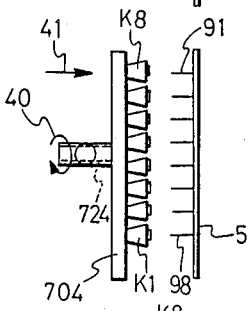
Figure 16D:
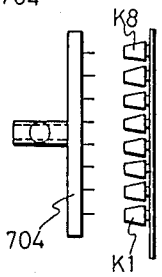

After completion of the package exchanging operation for the column 18*b* of the creel 5 of FIGS. 1, 3 in this manner, while the arm 704 is kept in the position shown in FIG. 16D, the creel 5 is moved one pitch P2 to position a next column 18*c* to the package exchanging position. Then, the same steps (a) and (b) of operation described above will be repeated again.

Figure 17:
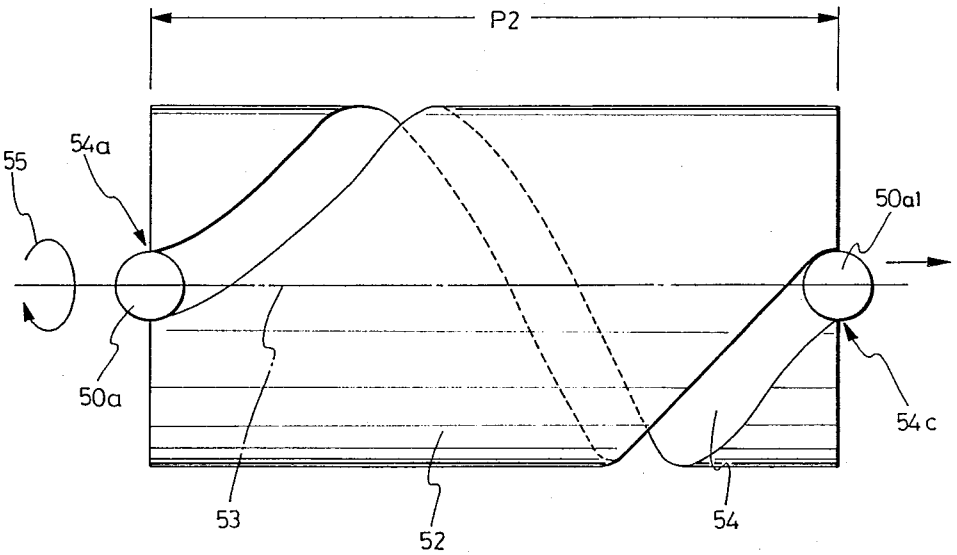
FIG. 17 is a front elevational view showing general construction of a pitch feeding mechanism for creels.

An example of a mechanism for intermittent feeding by a pitch P2 in the lining station B for creels 5*a* to 5*n* is indicated in FIGS. 3, 4 and 17. In particular, a plurality of cam rollers 50*a* to 50*f* are supported for rotation at locations corresponding to the peg columns on an upper frame 17*a* of each creel 5 while a cam grooved drum 52 adapted to engage with the cam rollers is supported for rotation on the rail 8 side. The cam grooved drum 52 rotates around a horizontal shaft 53 as shown in FIG. 17 and has a cam groove 54 formed on an outer periphery thereof for engagement with the rollers 50*a* to 50*f*.

The cam groove 54 extends from an entry side 54*a* to an exit side 54*c* of engagement with the cam roller 50a, and as the cam drum 52 is rotated one full rotation in a direction of an arrow mark 55, the cm roller 50*a* at the entry side position is moved to the exit side position 50*a*1. Here, the cam groove 54 of the cam grooved drum 52 is formed such that the distance P2 in a direction of an axis 53 of the drum 52 while the cam roller 50*a* is moved from the entry side position to the exit side position 50a1 of the cam groove 54 is equal to the pitch P2 between adjacent columns of pegs on the creel 5.

Accordingly, if the drum 52 is rotated one complete rotation in response to a signal representing completion of a package exchanging operation while the cam roller 50a, for example, is positioned at the entry side 54a of FIG. 17, then the roller 54a will advance a distance equal to the pitch P2 in a direction indicated by an arrow mark 56, thereby moving the creel 5 a distance equal to one pitch P2. At this instant, a following roller 50b arrives at the entry side 54a, completing the pitch feeding of the creel.

It is to be noted that, referring to FIG. 3, the opposite outermost columns 18a, 18f of the pegs on the creel 5 are spaced a distance P2/2 from adjacent opposite ends 16a, 16b of the frame member 16, respectively. Accordingly, where the creels 5a to 5n are lined up as seen in FIG. 1, the pitch between adjacent columns of pegs is constant (P2) over the entire creels, which allows the pitch feeding of all of the creels by intermittent rotation of the cam drum 52.

It is to be noted that, upon resuming the steps (a) and (b) described above, the pegs in the column 18c are displaced a distance equal to a half pitch P1/2 upwardly relative to those in the column 18b as seen in FIG. 3. Accordingly, the arm 704 in the vertical direction in the position shown in FIG. 15A must be lifted a distance P1/2 upwardly from its position for the preceding operation fro the column 18b. The amount of such lifting motion is determined by movement of the turning arm 713 by rotation of the motor M1 of FIG. 5.

Referring to FIG. 1, the various arrangements described hereinabove are controlled such that within a time while packages K1 to K8 at the lining position A are suspended onto the arm of the supply apparatus 700 and supplied to a creel and within a time of operation to draw out empty take-up tubes in a next column on the creel, empty trays t1 to t8 at the lining position B are allowed to be delivered in a direction indicated by an arrow mark 43 by releasing of the stopper 42 and new trays T1 to T8 onto which packages have been fitted at the package transferring position 300 undergo a yarn end picking up operation in a similar manner as described hereinabove and are then fed to the lining position A.

Accordingly, during a cycle of operations of the package exchanging apparatus to draw out empty take-up tubes and supply new packages, next new packages can be lined up at the lining position A. Accordingly, a large number of packages can be supplied to creels very efficiently without yielding a waiting time at the exchanging apparatus 700.

In the embodiment described above, it is described that only if packages at the lining station ST1 are lined up on trays T1 to T8 having a predetermined diameter D, the packages for a column of pegs on a creel will be lined up in a pitch equal to the pitch between adjacent pegs on the creel in the vertical direction. This also applies if the diameter of a yarn layer on a package itself is changed by a change of the type or the amount of a yarn on a yarn supply package due to a change of lots or specifications because the positions of the center holes of packages on lined up trays are always fixed. Accordingly, the package supporting arm of the exchanging apparatus 700 must simply repeat the same operation, and hence control of the exchanging apparatus can be simplified.

It is to be noted that while in the embodiment described above packages are lined up in a single row at the lining position A, this is associated with a premise that a package exchanging operation at the creel 5 shown in FIG. 3 is performed for each column of pegs as enclosed by a chain line 44, and in order to allow exchanging of packages in a similar cycle of operations to that described above also where a package exchanging operation is to be performed for a group of pegs which are arranged in a zigzag pattern, for example, as enclosed by a chain line 45 or 46, naturally the package transferring conveyor and the empty take-up pipe transporting conveyor must have sufficient width to allow trays to be arranged thereon in a zigzag pattern similarly to the arrangement of the pegs, and the arm 704 of the exchanging apparatus 700 must be replaced by another modified arm on which the package chucking members are mounted in a zigzag pattern.

It is also to be added that where packages are to be exchanged for each horizontal row of a creel as indicated by the chain line 45 in FIG. 3, the steps of turning the elongated arm 704 to its vertical position as shown in FIGS. 15B and 16C can be omitted, and hence exchanging of packages can be performed by a cycle of operations shown in FIGS. 15C, 15D, 16A and 16B.

As apparent from the foregoing description, according to the present invention, operation of exchanging packages on pegs on a large number of warper creels can be performed automatically, and the time required for such exchanging operations can be reduced remarkably.

What is claimed is:

1. A system for supplying packages having yarn wound thereon to a warper creel, comprising:

a plurality of package supporting pegs disposed on said warper creel;

collective transferring means for transferring a plurality of packages collectively to and from a corresponding plurality of said package supporting pegs on said warper creel, wherein said collective transferring means comprises:

a first conveyor for transporting packages;

a lining means for lining up packages transported by said first conveyor in a predetermined order; and a package exchanging means, located between said lining means and said creel, for collectively transferring a plurality of packages lined up in the predetermined order at said lining means to said pegs on the creel.

2. A system as claimed in claim 1, further comprising:

a plurality of transporting mediums, each transporting medium comprises a base plate which has a diameter equal to a pitch between adjacent package supporting pegs on the warper creel, each transporting medium further comprises a projecting member located at the center of the base plate for supporting a package thereon.

3. A system as claimed in claim 2, further comprising:

a yarn end finding apparatus for finding an end of a yarn on said packages.

4. A system as claimed in claim 3, wherein said yarn end finding apparatus comprises:

a rotary means for rotating a package in a direction which releases a yarn wound on said packages;

a drawing out means for attracting and drawing out an end of a yarn from the outer surface of a yarn layer on said packages, said drawing out means having a pivotable suction mouth operable for pivotal motion; and a cutter device for cutting yarn.

5. A system as claimed in claim 1, wherein said package exchanging means comprises a transferring means for collectively transferring a plurality of empty take-up tubes from said package supporting pegs on said warper creel and for collectively transferring a plurality of packages to said package supporting pegs on said warper creel, said transferring means comprises:

a travelling truck movable toward and away from said warper creel, a lifting member located on said truck, a package transfer arm located on said lifting member, two rectangularly crossing shafts for rotatably supporting said package transfer arm, and a plurality of package supporting devices disposed on said package transfer arm.

6. A system as claimed in claim 5, wherein said plurality of package supporting pegs disposed on said warper creel are arranged in a plurality of columns and are spaced at a particular pitch and wherein said plurality of package supporting devices disposed on said package transfer arm consists of a number of package supporting devices which is equal to the number of said package supporting pegs in each column on said warper creel, said package supporting devices being spaced at a pitch substantially equal to said pitch between said package supporting pegs on said warper creel, each of said package supporting devices comprises chucking members having an engaging portion for engaging a package, a grasping means for grasping a package and suspending the package thereon, and pressing means for pressing an end of said yarn.

7. A system as claimed in claim 5, further comprising:

a positioning means disposed on said truck for setting the vertical position of said package transfer arm.

8. A system as claimed in claim 1, further comprising:

a plurality of transporting media, each transporting medium having fitting means on which a package is fittable;

a ceiling rail for transferring packages;

a second conveyor an unloading apparatus for unloading packages transferred along said ceiling rail and for placing them onto said second conveyor;

a transfer apparatus for transferring packages placed on said second conveyor to said fitting means on said transporting media;

said first conveyor having a lining position, said first conveyor being operable for transporting packages fitted on transporting media to said lining position;

a yarn end finding apparatus, disposed adjacent said first conveyor between said transfer apparatus and said lining position, for finding an end of yarn on said packages; and an empty take-up tube transporting conveyor system for transporting empty take-up tubes.

9. A system as claimed in claim 8, wherein said package unloading apparatus comprises:

a pair of shafts;

a pair of levers mounted for turning motion around said shafts;

a pair of package transferring members connected between the levers;

a third conveyor;

a package receiving table adjacent said third conveyor.

10. A system as claimed in claim 9, wherein said transfer apparatus comprises:

a movable package receiving dish movable between a position adjacent an end of said third conveyor and a position adjacent said first conveyor;

a hydraulic cylinder for driving the receiving dish; and a motion transmitting lever.

11. A system as claimed in claim 10, wherein said receiving dish comprises:

a bottom plate for supporting a bottom face of a package, a reference side plate for supporting an outer periphery of a yarn layer of the package, and a frame member for supporting the bottom plate and the reference side plate thereon, said bottom plate having a recess formed therein.

12. A system for supplying a plurality of packages to a corresponding plurality of spatially separated pegs on a warper creel and for removing a plurality of empty take-up tubes supported by said pegs, said system comprising:

a lining means for lining up a plurality of packages a movable member movable with respect to said lining means and said warper creel;

transferring means, disposed on said movable member, for collectively transferring a plurality of packages from said lining means to a corresponding plurality of pegs on said warper creel, said transferring means further being operable for collectively receiving a plurality of empty take-up tubes doffed from a corresponding plurality of pegs on said warper creel.

13. A system as claimed in claim 12, further comprising:

a first conveyor operable for conveying a plurality of packages;

a second conveyor operable for conveying a plurality of empty take-up tubes;

wherein said movable member comprises a truck operable for movement from said first conveyor to said warper creel and from said warper creel to said second conveyor.

14. A system as claimed in claim 13, wherein said transferring means comprises:

a package transfer arm disposed on said truck;

a plurality of grasping means disposed on said package transfer arm, said plurality of grasping means being operable for grasping a corresponding plurality of packages conveyed by said first conveyor, said plurality of grasping means further being operable for grasping a corresponding plurality of empty take-up tubes supported by said plurality of pegs on said warper creel; and releasing means operable for releasing said packages and said take-up tubes grasped by said grasping means.

15. A system as claimed in claim 14, wherein said plurality of grasping means are aligned in a spatially separated relation, spatially separated by a distance corresponding to the distance between said spatially separated pegs on said warper creel.

16. A system as claimed in claim 15, wherein said first conveyor comprises:

a package aligning means for aligning a plurality of packages in a spatially separated relation, spatially separated by a distance corresponding to the distance between said spatially separated pegs on said warper creel.

17. A system for transferring a plurality of packages to a corresponding plurality of spatially separated pegs on a warper creel and for removing a plurality of empty take-up tubes from a corresponding plurality of pegs on said warper creel, said system comprising:

a first conveyor having a package lining means, said first conveyor being operable for conveying a plurality of packages to said package lining means;

a second conveyor for conveying a plurality of empty take-up tubes;

a movable member movable from said package lining means to said warper creel and from said warper creel to said second conveyor; and transferring means disposed on said movable member, said transferring means being operable for collectively transferring a plurality of packages from said package lining means to a corresponding plurality of pegs on said warper creel and for collectively transferring a plurality of empty take-up tubes from a corresponding plurality of pegs on said warper creel to said second conveyor.

18. A system as claimed in claim 17, wherein said package lining means includes means for aligning a plurality of packages in a spatially separated relation, spatially separated by a distance corresponding to the distance between said spatially separated pegs on said warper creel.

19. A system as claimed in claim 18, wherein said transferring means comprises:

a plurality of releasable grasping means operable for releasable grasping a corresponding plurality of packages and for releasable grasping a corresponding plurality of empty take-up tubes;

wherein said plurality of releasable grasping means are aligned in a spatially separated relation, spatially separated by a distance corresponding to the distance between said spatially separated pegs on said warper creel.

20. A system for transferring a plurality of packages to a corresponding plurality of spatially separated pegs aligned on a warper creel, said system comprising:

a lining station for lining up a plurality of packages;

a movable member movable between said lining station and said pegs on said warper creel;

a plurality of releasable grasping means, disposed on said movable member, for collectively grasping a corresponding plurality of packages lined up at said lining station and for collectively releasing said plurality of packages on a corresponding plurality of pegs on said warper creel.

21. A system as claimed in claim 20, wherein said plurality of releasable grasping means are aligned in a spatially separated relation, spatially separated by a distance corresponding to the distance between said spatially separated pegs on said warper creel.

* * * * *